US012773057B2

(12) United States Patent
Braegger

(10) Patent No.: US 12,773,057 B2
(45) Date of Patent: Oct. 27, 2026

(54) HANDS-FREE SHOEHORN

(71) Applicant: Elise Braegger, West Jordan, UT (US)

(72) Inventor: Elise Braegger, West Jordan, UT (US)

( * ) Notice: Subject to any disclaimer, the term of this patent is extended or adjusted under 35 U.S.C. 154(b) by 0 days.

(21) Appl. No.: 18/964,449

(22) Filed: Dec. 1, 2024

(65) Prior Publication Data

US 2025/0176747 A1 Jun. 5, 2025

Related U.S. Application Data

(60) Provisional application No. 63/605,433, filed on Dec. 1, 2023.

(51) Int. Cl.
*A47G 25/82* (2006.01)

(52) U.S. Cl.
CPC ..... *A47G 25/82* (2013.01)

(58) Field of Classification Search
CPC ..... A47G 25/80; A47G 25/82; A47G 25/86
See application file for complete search history.

(56) References Cited

U.S. PATENT DOCUMENTS

2018/0303264 A1* 10/2018 Katz ..... A47G 25/80

FOREIGN PATENT DOCUMENTS

| | | | | |
|---|---|---|---|---|
| KR | 20060068623 A | * | 6/2006 | ..... A47G 25/82 |
| KR | 20100137089 A | * | 12/2010 | ..... A47G 25/82 |
| KR | 102586764 B1 | * | 10/2023 | ..... A47G 25/82 |
| WO | WO-2024049359 A1 | * | 3/2024 | ..... A47G 25/82 |

OTHER PUBLICATIONS

Shoehorn, https://en.wikipedia.org/wiki/Shoehorn, Nov. 30, 2024.
Long Handled Spring Action Shoe Horn, https://www.amazon.com/Long-Handled-Spring-Action-Shoe/dp/B001521798, Nov. 30, 2024.

* cited by examiner

*Primary Examiner* — Nathan E Durham
(74) *Attorney, Agent, or Firm* — Randy Braegger

(57) ABSTRACT

A hands-free shoehorn device may include a base and a vertical support coupled to the base, the vertical support extending vertically from the base. A shoehorn may be coupled to the vertical support and extend toward the base. A shoe support may be coupled to the base and configured to support footwear. At least a portion of at least one of the shoe support or the shoehorn is vertically movable toward an other one of the shoe support or the shoehorn.

14 Claims, 13 Drawing Sheets

HANDS-FREE SHOEHORN

RELATED APPLICATION

This application claims the benefit of U.S. Provisional Application No. 63/605,433, filed on Dec. 1, 2023, the entire content of which is incorporated herein by reference.

BACKGROUND

Footwear is commonly worn by humans for a variety of reasons, such as protecting the foot, warming the foot, displaying a style or fashion, etc. When wearing footwear, it is often desired for the footwear to be well-fitting. Ill-fitting footwear can cause pain, issues with mobility, and the like. However, when footwear, such as a shoe, closely fits the foot of a wearer, if the material of the shoe has limited flexibility or stretchability, or if the shoe is not designed with adjustability, fitting the foot into the shoe can be challenging. A variety of types of footwear have been developed with laces, straps, elastic and the like to allow loosening of a portion of the footwear to insert the foot before the portion of the footwear is tightened.

Sometimes, even with flexible, stretchable or adjustable configurations of footwear, fitting the foot into the footwear can be difficult. In particular, while the toes and ball of the foot may often readily enter a portion of the footwear, fully inserting the foot to include the heel of the foot inserted to a heel portion of the footwear can be difficult due to geometries of a human foot and a desire to provide a close fit of the footwear to the user after insertion of the foot.

A shoehorn, also referred to as a shoe spoon, shoe schlipp or shoe tongue, is a tool that commonly includes a handle to be held by a human hand at one end while another end is configured to be inserted into the heel portion of footwear to assist a user in fitting the foot, especially the heel, into the footwear. It is useful in assisting a foot to fit into the footwear that does not otherwise easily fit. Shoehorns are commonly thin to not occupy a large space when inserted into a shoe but are often a rigid material to assist in easing the foot into the footwear. Some example materials include metal, plastic, wood, glass, bone and the like. It is common for a shoehorn to include a curvature and be configured for use with the curvature of the shoehorn corresponding to a curvature of the heel of the foot and/or of the heel of the shoe. A variety of shoehorns have been developed over the centuries with some variation in materials, size, shape and the like.

DETAILED DESCRIPTION

Detailed descriptions will be given below of a configuration of the present technology with reference to the accompanying drawings.

While shoehorns have been in use for many years, a conventional shoehorn device may be limited in accessibility due to a typical configuration where a user grasps one end of the shoehorn with their hand while bending over to hold the shoehorn in place while inserting a foot into footwear. Various challenges exist due to this method of use. Some users may find it difficult to maintain a standing balance while using such a shoehorn. Some users may have difficulty bending over to position the shoehorn relative to the footwear. Some users may have difficulty grasping a shoehorn due to pain, limited motor function, missing fingers or arms, etc. The present technology has been configured as a hands-free shoehorn device that enables use without requiring a user to user hands or the bend their body. A user can assume a more natural and stable sitting or standing position to use the hands-free shoehorn device of the present technology. The hands-free shoehorn device of the present technology improves accessibility of the use of shoehorns to individuals who may have physical limitations or challenges.

Figure 1A:
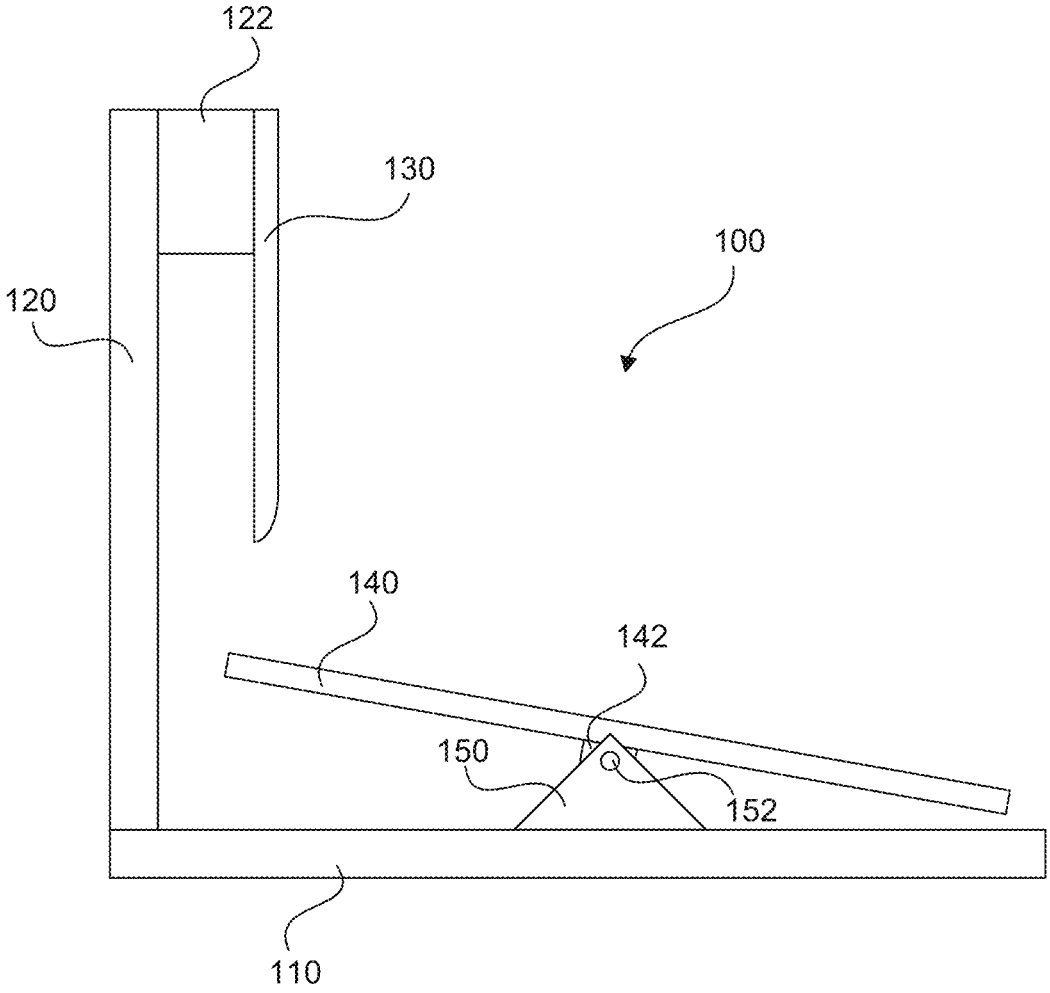
FIG. 1A is a side view of a hands-free shoehorn device according to an embodiment of the present technology.

Reference will now be made to FIGS. 1A-1F. FIG. 1A is a side view of a hands-free shoehorn device according to an embodiment of the present technology. FIGS. 1C-1F are bottom, top, rear and front views of the hands-free shoehorn device of FIG. 1A.

A hands-free shoehorn device 100 according to one embodiment of the present technology may include a base 110 and a vertical support 120 coupled to the base 110, the vertical support 120 extending vertically from the base 110. A shoehorn 130 may be coupled to the vertical support 120 (via a spacer 122 spacing the shoehorn over the shoe support 140) and extend toward the base 110. A shoe support 140 may be coupled to the base 110 and may be configured to support footwear (see, e.g., footwear 260 in FIGS. 2A-2D).

Figure 1B:
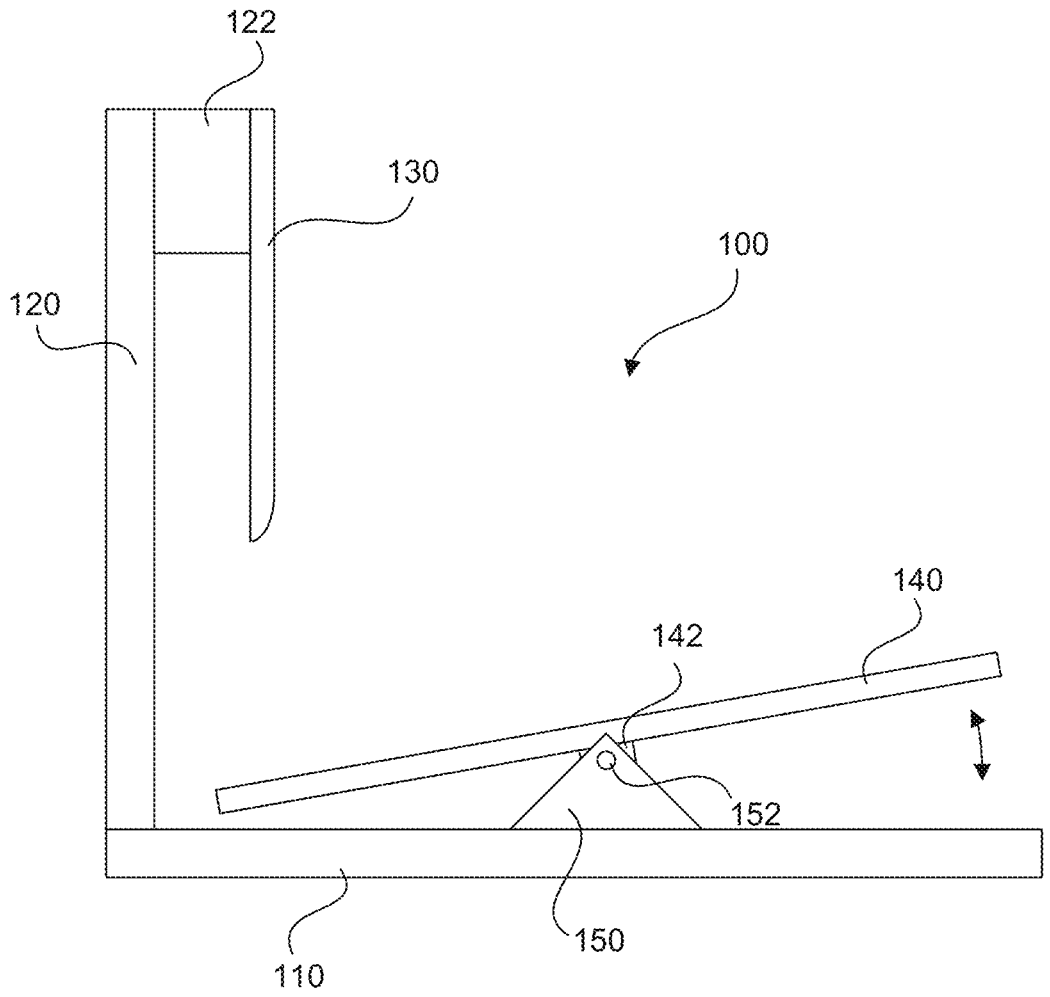
FIG. 1B is the side view of the hands-free shoehorn device of FIG. 1A, illustrating a pivoted position of a shoe support according to an embodiment of the present technology.
Figure 1C:
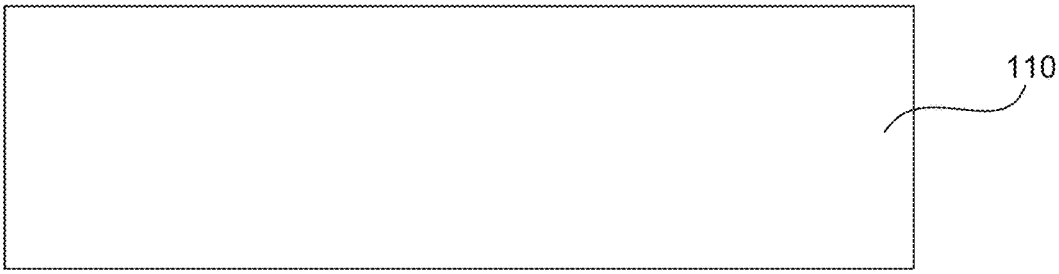
FIG. 1C illustrates a bottom view of the hands-free shoehorn device of FIG. 1A.
Figure 1D:
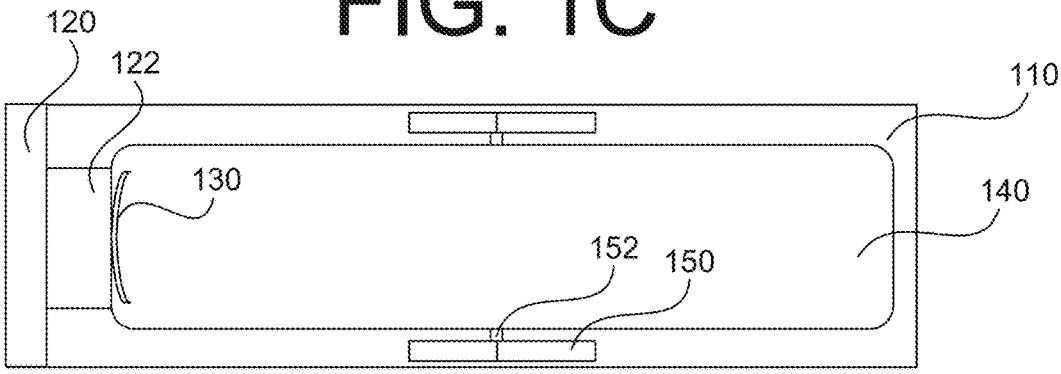
FIG. 1D illustrates a top view of the hands-free shoehorn device of FIG. 1A.
Figure 1E:
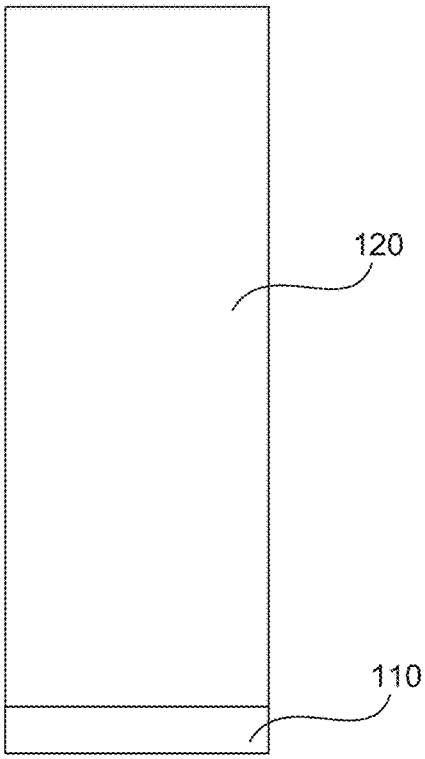
FIG. 1E illustrates a rear view of the hands-free shoehorn device of FIG. 1A.
Figure 1F:
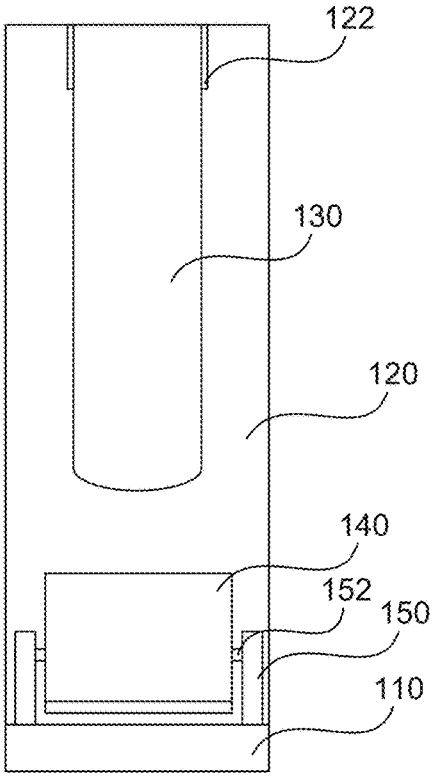
FIG. 1F illustrates a front view of the hands-free shoehorn device of FIG. 1A.

At least a portion of at least one of the shoe support 140 or the shoehorn 130 is vertically movable toward an other one of the shoe support 140 or the shoehorn 130, as illustrated by the movement of the shoe support 140 from a first position in FIG. 1A to a second position in FIG. 1B. In the embodiment shown in FIGS. 1A-1F, the shoe support 140 moves vertically toward the shoehorn 130 without vertical movement off the shoehorn 130. However, as will be described with reference to other embodiments, the shoehorn 130 may move without movement of the shoe support 140 or both the shoehorn 130 and the shoe support 140 may move to enable operation of the hands-free shoehorn device.

With continued reference to the embodiment of FIGS. 1A-1F, the hands-free shoehorn device 100 provides a pivot 150 upon which the shoe support 140 is pivotable. The pivot 150 may be a fulcrum upon which the shoe support 140 is supported and pivotable. The pivot 150 is illustrated as being positioned near a longitudinal center of the shoe support 140, but the pivot 150 in other embodiments (not shown) may be shifted off-center from the longitudinal center of the shoe support 140. By centering the pivot 150, a user may select a pivoted position of the shoe support 140, such as that of FIG. 1A or that of FIG. 1B, and anticipate that the shoe support 140 will remain in the selected position until the user changes the position. However, in an embodiment where the pivot 150 is off-center from the longitudinal center of the shoe support 140, a weight of a portion of the shoe support 140 on either side in the longitudinal direction of the pivot 150 may be unequal such that a resting position of the shoe support 140, absent an external force, may be a single position, such as that of FIG. 1B for example. It may be understood that even when the pivot is off-center from the longitudinal center of the shoe support 140, the weight of the shoe support 140 on either side in the longitudinal direction of the pivot 150 is not necessarily unequal and may instead be configured to be equal to allow resting positions of FIG. 1A or FIG. 1B or the like without additional forces maintaining such positions.

The pivoting configuration of the shoe support 140 upon the pivot 150 above may be a configuration where the shoe support 140 is freely pivotable upon the pivot 150 without friction that substantially limits the pivoting of the shoe support 140. For example, FIGS. 1A, 1B, 1D and 1F illustrate that the pivot 150 includes a rod 152. The rod 152 may have a substantially cylindrical shape and may pass through a connector 142 formed on an underside of the shoe support 140. The shoe support 140 may rest directly on the rod 152 or may rest indirectly on the rod 152 via the connector 142, and the connector 142 may pivotably secure the shoe support 140 to the rod 152 and the pivot 150 may be a pivot base which, taken together with the rod 152 and the connector 142, enables the pivoting of the shoe support 140 relative to the base 110 or the shoehorn 130.

As can be understood from FIGS. 1A-1B, pivoting the shoe support 140 upon the pivot 150 may move opposite longitudinal ends of the shoe support 140 in opposite vertical directions. An end of the shoe support 140 on a left side of FIG. 1A moves vertically down toward the base 110 as shown in FIG. 1B while an end of the shoe support 140 on a right side of FIG. 1A moves vertically up and away from the base 110 as shown in FIG. 1B due to the pivot being between ends of the shoe support 140. However, as will be understood through description of other embodiments of the present technology, the hands-free shoehorn device may be configured such that one longitudinal end of the shoe support 140 remains in a same vertical position during pivoting and only an opposite longitudinal end moves vertically relative to the base 110 or the shoehorn 130.

While the embodiment described above may be configured such that friction does not substantially limit the free rotation or pivoting of the shoe support 140 upon the pivot 150, alternative configurations are considered where a desired amount of friction is provided through a tight fit, surface roughness or the like to allow setting a pivoted position of the shoe support 140 at any available movement position within the range of positions such that the friction maintains that position without continued application of force.

The materials of the hands-free shoehorn device may vary depending on a desired construction and are not particularly limited. An example device built by the inventor of the present technology was made of wood and metal, where the base 110 and vertical support 120 were made of wood coupled together by metal screws, and the shoehorn 130 was a commercially available metal shoehorn attached to the vertical support 120 by metal screws. The pivot 150, including the rod 152, was made of wood and metal brackets were used as the connector 142 to attach the rod 152 to an underside of the shoe support 140 using metal screws. However, it will be readily understood that the shoehorn device may be made using a variety of materials or methods of manufacture to accommodate different price points, device weights, weight ratings, sizes and the like. For example, the device may be formed using various injection-molded parts. Various components of the hands-free shoehorn device may be integrally formed or separately formed. The hands-free shoehorn device may be configured to be at least partially disassembled when not in use or may be configured to remain in an assembled state. While the drawings illustrate the vertical support 120 and shoehorn 130 coupled to the base 110, it may be understood that a base 110 with shoe support 140 may be configured as separate and unattached from the vertical support 120 with shoehorn 130. While the hands-free shoehorn device is illustrated with particular shapes, relative dimensions, types of construction and the like, it will be understood that any other shapes, dimensions, methods of construction, etc. that may be understood by the skilled artisan to obtain the effect of the present technology are considered to be within the scope of the present technology. As one example variation on what is illustrated in FIGS. 1A-1F, the hands-free shoehorn device may include a handle formed at a top of the vertical support or on the base or the like for lifting and moving the device.

While reference may be made herein to a shoe, a person of ordinary skill in the art will understand that the technology may be applied to any of a variety of types of footwear not limited to any particular type, size or style of footwear for which the use of a shoehorn may assist a user in inserting a foot into the footwear. Likewise, a shoehorn is not limited to being used in connection with insertion of a foot into a particular type, size or style of footwear, but may generally refer to a device that may assist a user in inserting a foot into any of a variety of types of footwear. Some non-limiting example types of footwear which may be used include sneakers, high-tops, slippers, boots, clogs, flats, moccasins, galoshes, sandals, loafers, and many more.

Reference will now be made to FIGS. 2A-2E. FIGS. 2A-2E illustrate example usage of the hands-free shoehorn device. Similarly as in FIGS. 1A-1F, the hands-free shoehorn device of FIGS. 2A-2E may include a base 210, a vertical support 220, a shoehorn 230, a shoe support 240, and a pivot 250.

Figure 2A:
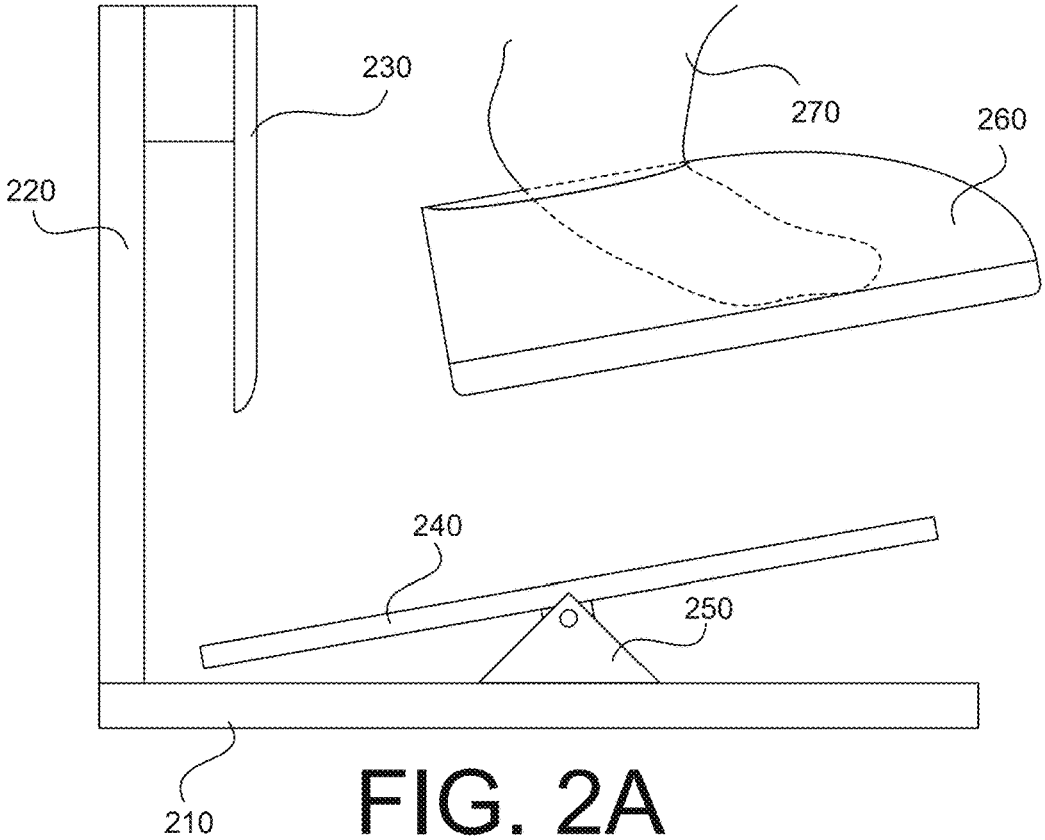
FIGS. 2A-2F illustrate example steps of use of the hands-free shoehorn device of FIG. 1A from the side views of FIGS. 1A-1B.

In FIG. 2A, a user has partially inserted a foot 270 into a shoe 260. In use, a user may have a shoe 260 already present on the hands-free shoehorn device, such as if the shoe 260 was removed using the hands-free shoehorn device or if the user placed the shoe 260 on the device. However, it is anticipated that at least one shoe of a pair of shoes may be stored separately from the hands-free shoehorn device. FIG.

2A illustrates a user picking up a shoe 260 by partial insertion of the foot 270 into the shoe 260 and lifting the shoe 260 into a position relative to the hands-free shoehorn device.

Figure 2B:
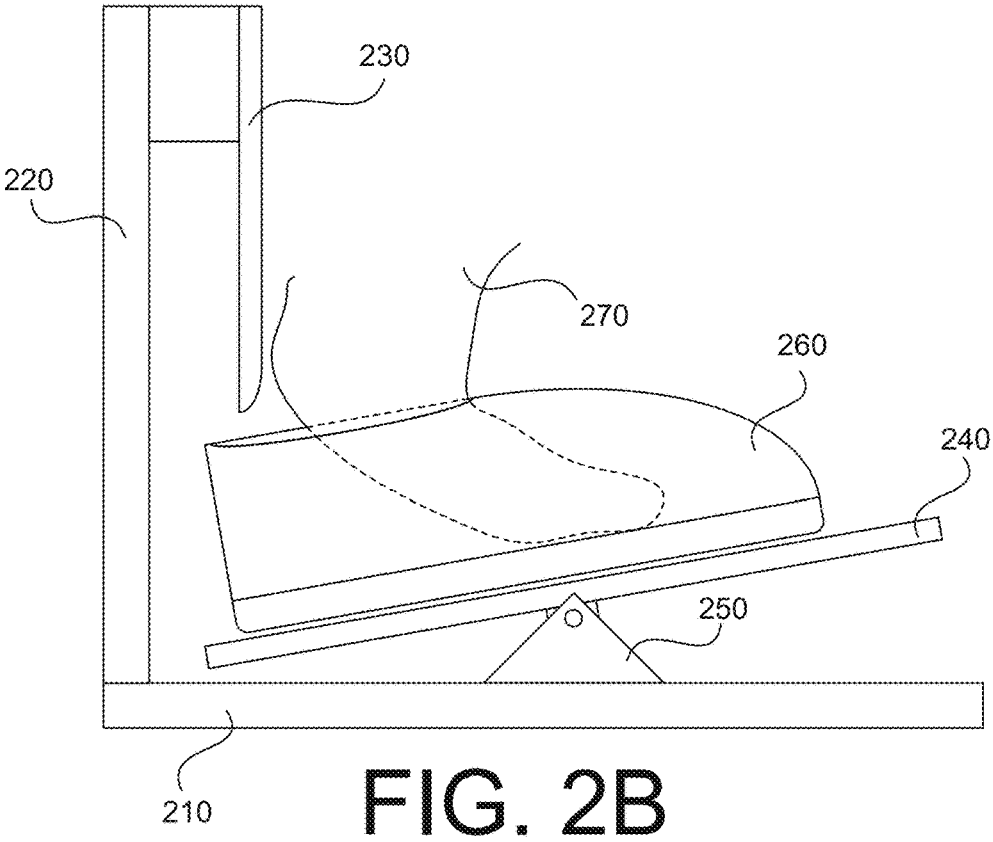

FIG. 2B illustrates the placement of the shoe 260 on the shoe support 240. At this time, the shoe support 240 is pivoted to a position similar to that of FIG. 1B so that a top of the heel of the shoe 260 is vertically below a lower end of the shoehorn 230. If the pivoted position of the shoe support 240 corresponded to the position illustrated in FIG. 1A, the user may lightly press on an end of the shoe support 240 which is more proximal to the shoehorn 230 to adjust the pivoted position of the shoe support 240 upon the pivot 250 to correspond to that of FIG. 1B. The user may lightly press on the end of the shoe support 240 using the foot 270, with or without partial insertion of the foot 270 into the shoe 260.

After the shoe 260 has been placed on the shoe support 240 as shown in FIG. 2B, the user may press down on an end of the shoe support 240 which is more distal from the shoehorn 230 to adjust the pivoted position of the shoe support 240 upon the pivot 250. In other words, the user may press down with their foot 270, through the shoe 260, on an opposite side of the shoe support 240 from the pivot 250 as a side of the pivot 250 on which the shoehorn 230 is disposed. In this case, the user may press down on the shoe support 240, through the shoe, using the partially inserted portion of the foot 270, such as using the toes or the ball of the foot or the like.

Figure 2C:
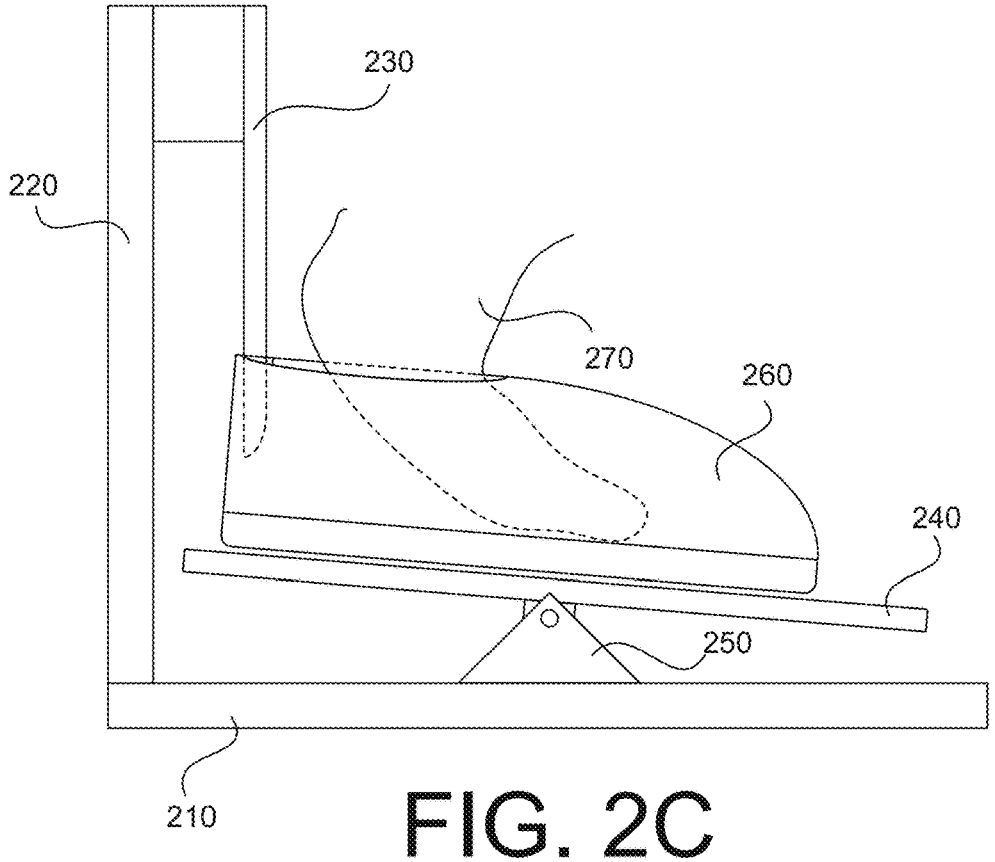
Figure 2D:
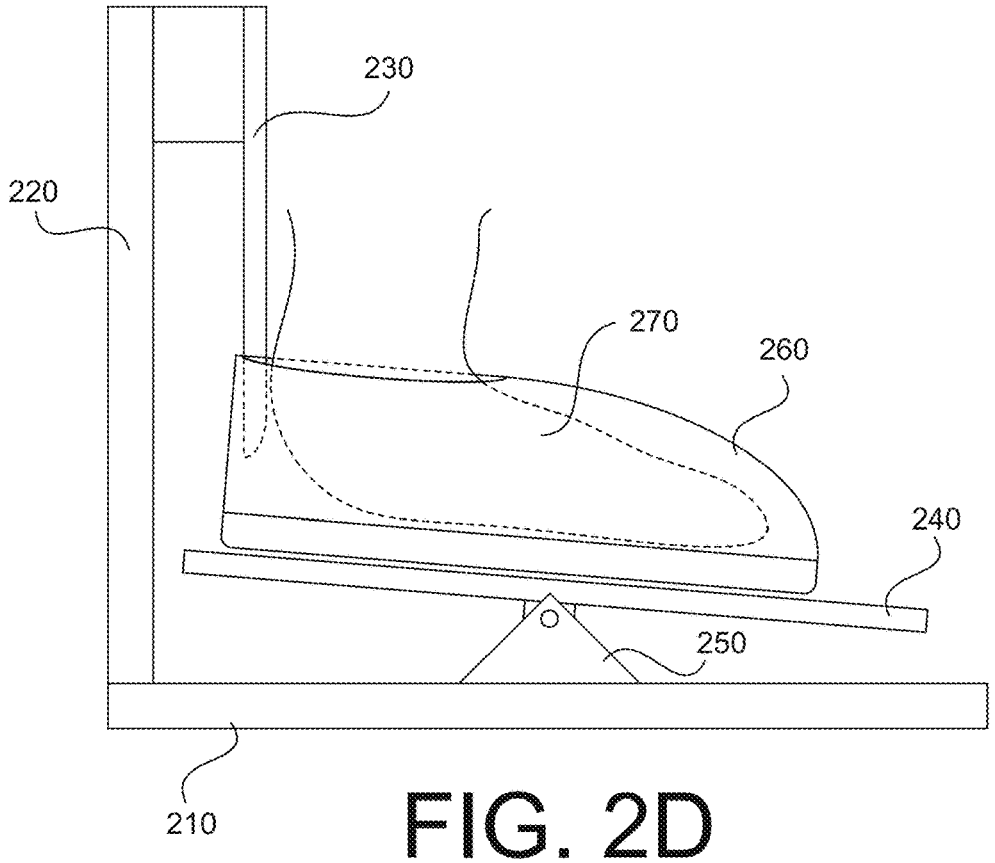

As may be understood with reference to FIG. 2C, as the shoe support 240 is pivoted by the user pressing with the portion of the foot 270 inserted into the shoe 260, the opposite end of the shoe support 240 (which is the end more proximal to the shoehorn 230) is raised toward the shoehorn 230, raising the heel portion of the shoe to the shoehorn 230 such that the shoehorn 230 is inserted into the shoe 270. In this state, while continuing to press downward toward the toe end of the shoe 260, the user may also move the foot 270 laterally toward the toe of the shoe 260, away from the shoe horn 230. Because the shoehorn 230 is inserted into the shoe 260, the shoe 260 may not slide on the shoe support 240. The user may force their foot 270 forward and into the shoe 260 while the shoe 260 is held in place and the heel portion of the shoe 260 is supported from collapsing. FIG. 2D illustrates the foot 270 inserted into the shoe 260 with the shoehorn 230 inserted at a back of the shoe.

Figure 2E:
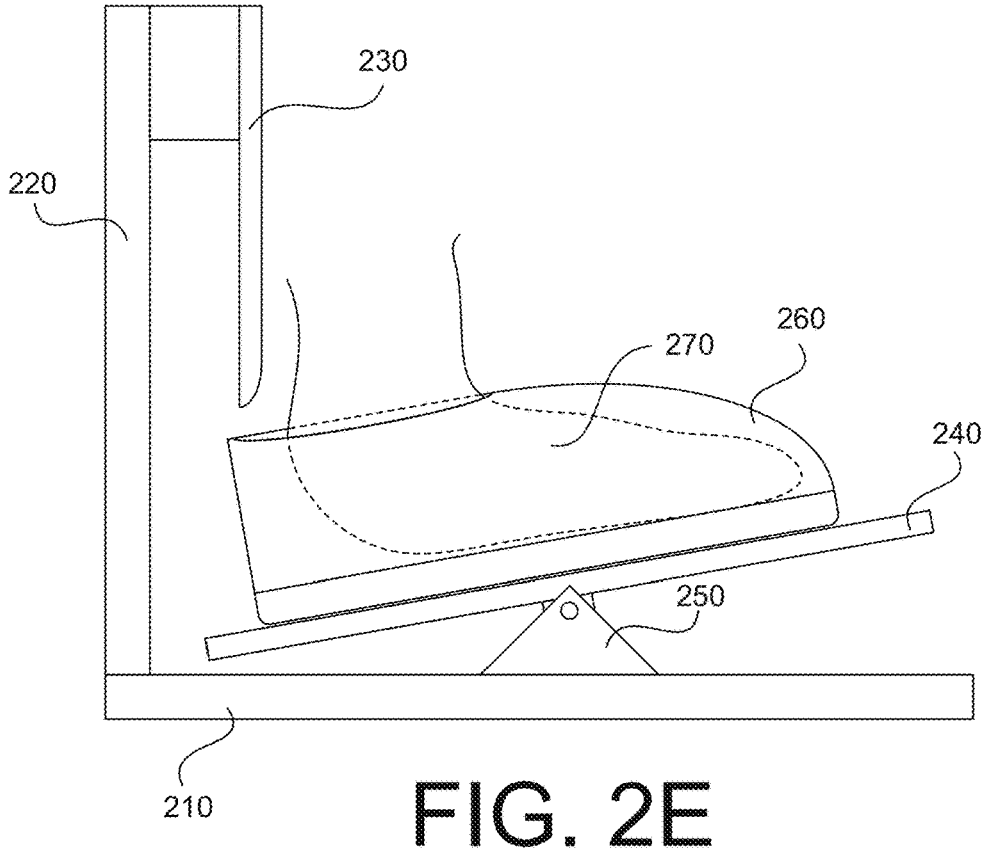

Referring to FIG. 2E, the user may press down with the heel of their foot 270 on a side of the shoe support 240 proximal to the shoehorn 230, pivoting the shoe support 240 upon the pivot 250, to remove the shoehorn 230 from the shoe 260. Once the shoehorn 230 has been removed from the shoe 260, the user may lift their foot 270, including the shoe 260 into which the foot 270 is inserted, away from the hands-free shoehorn device. The process of FIGS. 2A-2F may be repeated to wear another shoe on another foot.

Figure 2F:
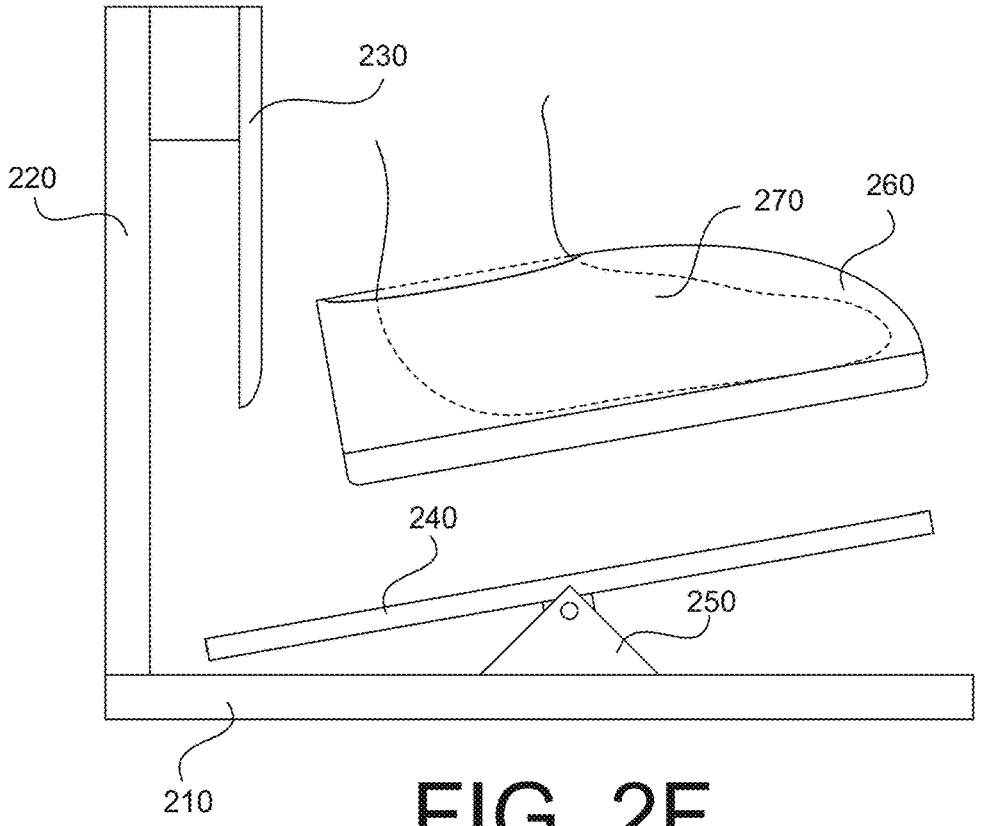

While the present hands-free shoehorn device has been described in the context of assisting a user to put shoes onto their foot, the hands-free shoehorn device may also be used to assist a user to remove shoes from their foot. A user in some cases may simply use one foot to press down on the back of the heel of the shoe worn on another foot to remove the shoe, but in other cases the shoehorn device may be easier or less damaging to the shoes. To use the device to remove shoes, the process of FIGS. 2A-2F is completed in reverse. In other words, the foot 270 wearing the shoe 260 is positioned on the device as shown in FIGS. 2F and 2E. Subsequently, the shoe support 240 is pivoted to insert the shoehorn 230 into the shoe 260 as shown in FIG. 2D. The user may lift their foot 270 at least partially up and out of the shoe 260 as shown in FIG. 2C, with the inserted shoehorn 230 limiting or restricting vertical movement of the shoe 260. After the foot 270 has been sufficiently removed from the shoe 260, the foot 270 can lightly press down, through the shoe near the heel of the shoe, to pivot the shoe support 240 such that the shoehorn 230 is removed from the shoe 260, as shown in FIG. 2B, and then the user can lift the shoe away from the hands-free shoehorn device as shown in FIG. 2A.

While not shown in the drawings, the shoe support may optionally have one or more raised portions formed at one or more ends and/or one or more sides to function as a guide for placement of shoes on the shoe support. Further, the shoe support surface which contacts the shoe may optionally be configured with minimal friction (e.g., the surface may be a smooth surface) to allow shoes to slide into a desired position or with a friction surface to limit movement of the shoe on the shoe support. A friction surface may include, for example, a roughened surface or a surface with a desired tackiness (e.g., a rubberized surface, or an adhesive-covered surface or the like). The base 210 of the hands-free shoehorn device may optionally have a friction surface to prevent sliding of the device on the ground as the user is inserting or removing a foot from the shoe using the device.

Referring now to FIGS. 3A-3E, embodiments of a hands-free shoehorn device according to the present technology are illustrated which include a resilient member coupled to the shoe support. The hands-free shoehorn device in these drawings is similar in some respects to the previously described embodiments, where the device includes a base 310, a vertical support 320, a shoehorn (not shown), and a pivoting shoe support 340. In each of these drawings, arrows are added to indicate various forces and directions of movement from the illustrated position.

Figure 3A:
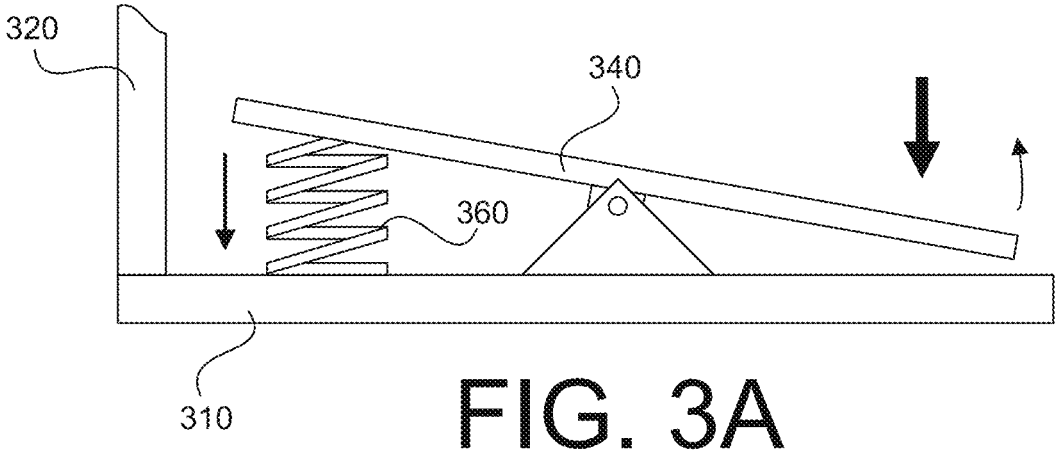
FIGS. 3A-3E illustrate embodiments of a hands-free shoehorn device according to the present technology which include a resilient member coupled to the shoe support.

In FIG. 3A, an embodiment is provided similar to the embodiment of FIG. 1A, except that a resilient member is provided which is coupled to the shoe support 340 and the base 310. Any of a wide variety of resilient members may be used, but some non-limiting examples which are described here include an elastic or a spring. Some non-limiting examples of a spring include a cantilever spring, a coil spring, and a torsion spring. FIG. 3A illustrates a coil spring 360 coupled between the shoe support 340 and the base 310. FIG. 3A illustrates a downward arrow near the coil spring 360 indicating that in the illustrated position of FIG. 3A, the coil spring 360 is urging the end of the shoe support 340 to which the coil spring 360 is attached downward and closer to the base 310. In other words, the coil spring 360 in FIG. 3A is in a stretched position where the resilient nature of the coil spring 360 provides a force towards equilibrium in a non-stretched state of the coil spring 360. A resting position of the shoe support 340 in the embodiment of FIG. 3A is similar to the pivoted position of the shoe support 140 illustrated in FIG. 1B. However, FIG. 3A also illustrates a thicker arrow near the right-hand side of the shoe support 340 which represents a larger force pressing down on that end of the shoe support 340, such as when a user is using the hands-free shoe support to wear a shoe. The force provided by the resilient member, in this example the coil spring 360, is not so great as to make it difficult for the user to press on the shoe support 340 to pivot the shoe support 340 and insert the shoehorn into a shoe. If the force from the user's foot is removed, the coil spring 360 will urge the shoe support 340 closer to a pivoted position similar to that in FIG. 1B, where the curved arrow in FIG. 3A illustrates a direction of movement of the pivoting.

Figure 3B:
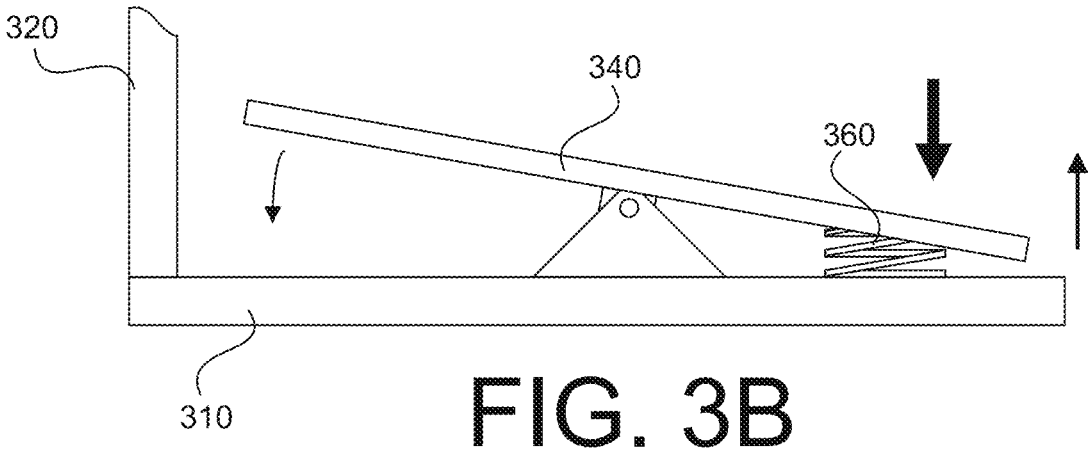

FIG. 3B illustrates another embodiment, also including a coil spring 360 as the resilient member, but where the coil spring 360 is provided at an opposite end of the shoe support 340 as in the embodiment of FIG. 3A. Similar to the embodiment of FIG. 3A, a resting or equilibrium position of the spring is where the shoe support 340 is in a position similar to the pivoted position of FIG. 1B. The thin arrow to the right of the coil spring 360 illustrates the force supplied by the coil spring 360 urging the shoe support 340 to the resting position. The curved arrow at the left, underneath the shoe support 340, represents the movement of the shoe support 340 to the resting position. The thicker arrow above the coil spring 360 illustrates an external force supplied by a user's foot when using the hands-free shoehorn device, which external force from the user is greater than the force provided by the coil spring 360. The provision of a spring as in FIGS. 3A-3B resets a pivoted position of the shoe support 340 after use or after transport of the device or the like so that the device is ready to be used without first pivoting the shoe support 340 to provide space for the shoe between the shoe support and the shoehorn.

Figure 3C:
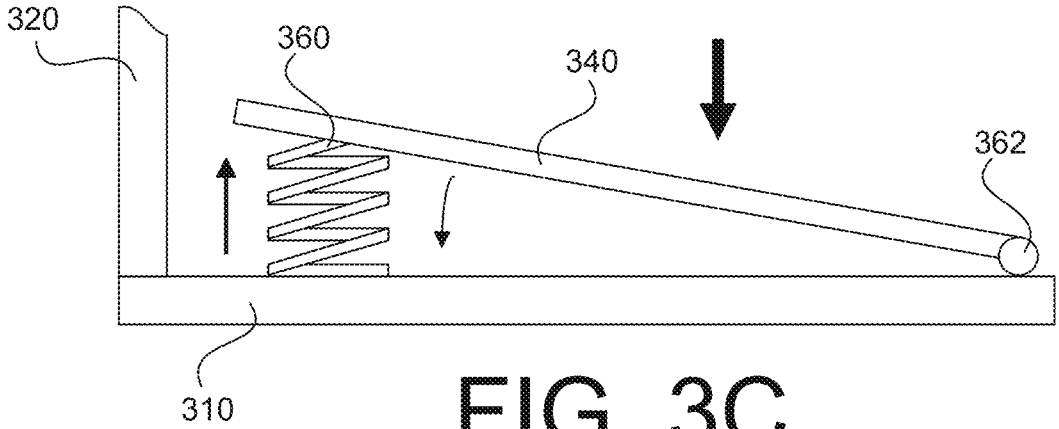

FIG. 3C represents another embodiment of the present technology using a coil spring 360 as a resilient member, where a pivot is provided in the form of a hinge 362 at one end of the shoe support 340, opposite from the end closest to the vertical support 320 and the shoehorn. In one embodiment not shown, a torsion spring may be incorporated into the hinge and the coil spring 360 may be omitted. In the illustrated example, the coil spring 360 urges the shoe support 340 to a resting position similar to the position of FIG. 1A, as indicated by the vertical thin arrow to the left of the coil spring 360. A larger force indicated by the thick arrow above the shoe support 340 may be applied by the user's foot to compress the coil spring 360 and force the shoe support 340 closer to the base 310, as indicated by the curved arrow, and make a space for the user's shoe between the shoe support 340 and the shoehorn. The user may reduce the downward force to a weaker force than the upward force supplied by the coil spring 360 such that the coil spring forces the shoe support 340 to pivot upward with the heel of the shoe closer to the shoehorn.

Figure 3D:
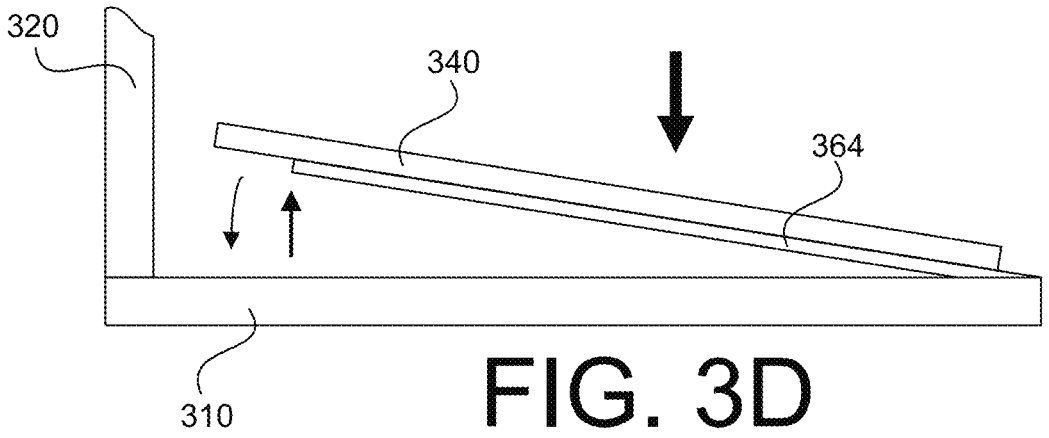

FIG. 3D illustrates a cantilever spring 364 as the resilient member. The cantilever spring 364 is attached to the base 310 near one end of the base 310 and near one end of the shoe support 340. The operation of this embodiment is similar to that of FIG. 3C. In other words, the illustrated position is the resting position, the curved arrow indicates the direction of movement when a large downward force is applied by a foot, and the thinner vertical arrow indicates the force toward the resting position when the large downward force is applied. In one example, the cantilever spring 364 may be a straight, flexible and resilient, metal member with one end embedded in the base 310. As another example, the cantilever spring 364 may include a bent portion (not shown) bent and extending back towards the vertical support 320 and embedded in or attached to the base 310. Various methods and means of attachment will be apparent to the skilled artisan, such as mechanical attachment via screws or the like, adhesive attachment, etc.

Figure 3E:
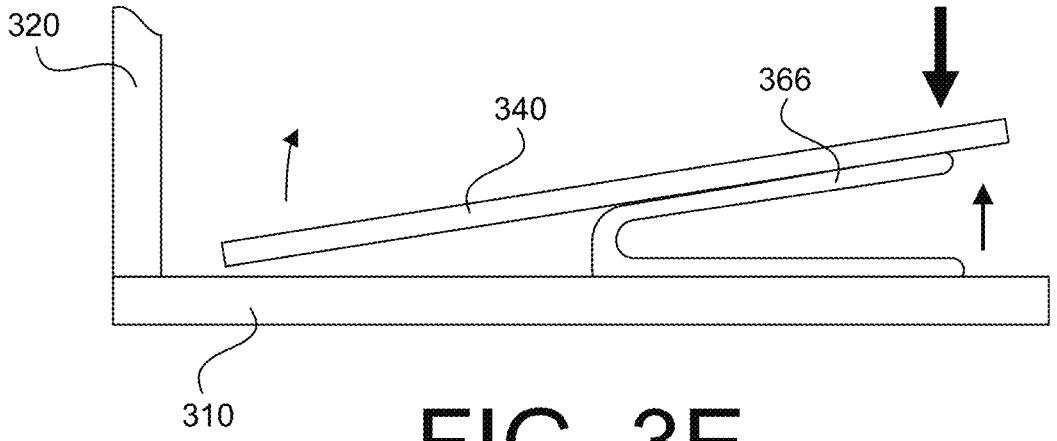

FIG. 3E illustrates a different cantilever spring 366 embodiment as the resilient member. In this case, the illustrated position is the resting position and a large downward force supplied by a user's foot may be applied to overcome a smaller upward force supplied by the cantilever spring 366. The cantilever spring 366 of FIG. 3E includes a bent portion which is positioned between the ends of the shoe support 340 to provide a pivot point. Whereas the cantilever spring 364 of FIG. 3D pivoted the shoe support 340 through vertical movement of substantially only one end of the shoe support 340, placement of the bent portion between the ends of the shoe support 340 causes both ends of the shoe support 340 to move during pivoting, similar to the embodiment of FIGS. 1A-1B.

Figure 4A:
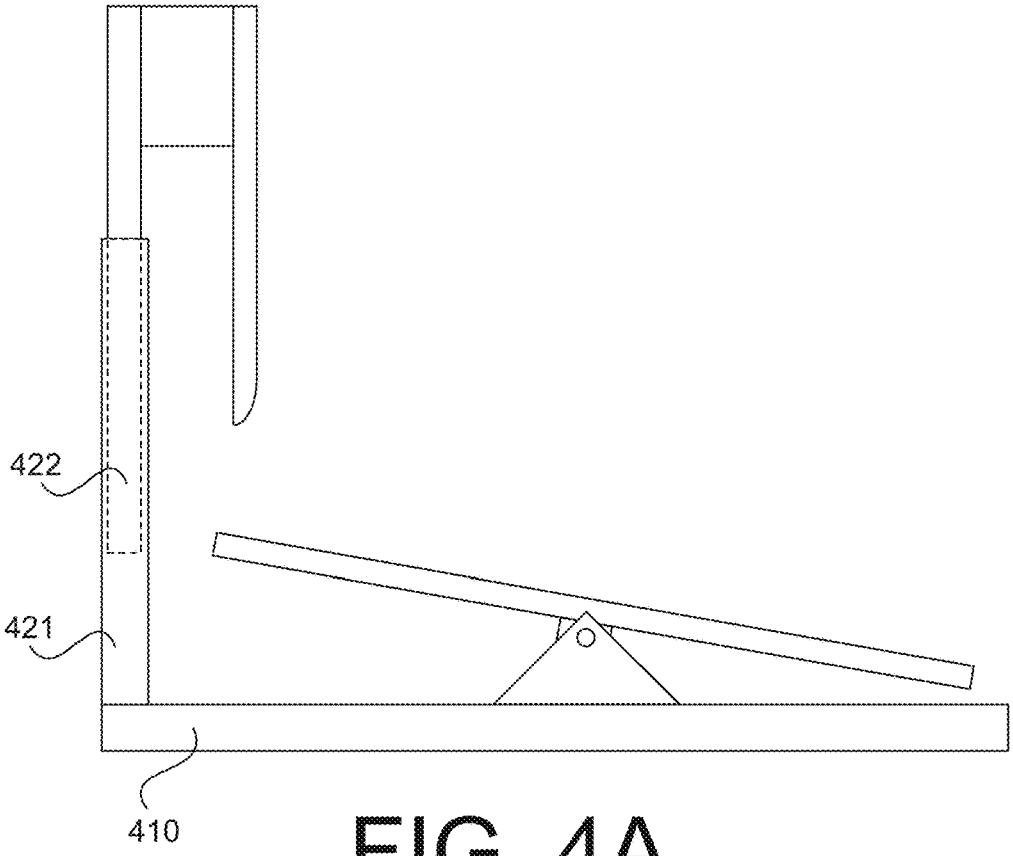
FIGS. 4A-4B illustrate an adjustable vertical support for adjusting a height of a shoehorn relative to a base or a position of footwear, according to an embodiment of the present technology.
Figure 4B:
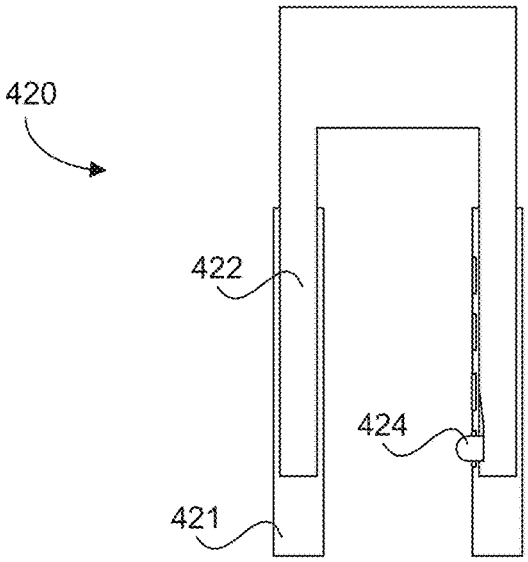

FIGS. 4A-4B illustrate an embodiment of the present technology where a vertical height of the vertical support 420 is adjustable. FIG. 4A illustrates a side view of the hands-free shoehorn device including an adjustable vertical support 420 and FIG. 4B illustrates a cross-sectional front view of the vertical support 420 of FIG. 4A. Any of a variety of mechanisms for adjustability will be apparent to the skilled artisan. The illustrated embodiment includes receiver 421 which is a portion of the vertical support 420 coupled to the base 410 and an insert 422 configured to slide within the receiver 421. The receiver 421 may be formed as a hollow tube, which may have a square, circular or other cross-sectional shape. In the illustrated embodiment, the receiver 421 includes a plurality of openings formed therein, sized and shaped to correspond to one or more spring-loaded push buttons 424 formed on the insert 422. By pressing the push button 424 through the openings and applying a vertical force to the insert 422, a vertical position of the insert 422 relative to the receiver 421 can be adjusted. The push button 424 may be urged through an opening at an adjusted vertical position by the spring-loading of the push button 424 to lock a vertical position of the vertical member. A user of the hands-free shoehorn device, or a caretake or the like, may use hands to adjust the position to a suitable position for the user's desired shoes. In other words, whereas some shoes may have different sizes and/or the heels of some shoes may be taller than others, vertical adjustment of the vertical support may enable accommodation of a variety of shoes. While not illustrated, an additional or alternative embodiment is to either provide an adjustable length shoehorn or to provide a plurality of shoehorns of different lengths so that the user can select an appropriate length shoehorn for attachment to the hands-free shoehorn device. Likewise, the spacer formed as part of the vertical support to space the shoehorn over the shoe support may be replaceable with different sizes of spaces for a desired adjustment.

In one embodiment not illustrated, the vertical support may be vertically adjustable with an elastic or a spring to return the vertical support to a starting or resting position after displacement. In this example, a user may stretch or elastically deform an elastic or spring or the like using a foot or a leg to force adjustment of the height of the vertical support and/or of the shoehorn attached to the vertical support downward toward a waiting shoe to insert the shoehorn into the shoe. In such an embodiment, a shoe support may either not be pivoted or otherwise moved or the shoe support may pivot or move in an opposite direction as the vertical support. For example, when a user presses using a foot to pivot the shoe support from the position of FIG. 1B to the position of FIG. 1A, an internal mechanism coupled to the shoe support may pull the shoehorn and/or a portion of the vertical support vertically downward. As another example, a lever may be provided extending toward the rear of the shoe support to allow a user to slightly crouch to press the lever with their thigh and move the shoehorn and/or a portion of the vertical support downward. In one or more of such embodiments, as well as in some embodiments which may be described later, the shoe support may be formed integrally with the base.

Figure 5A:
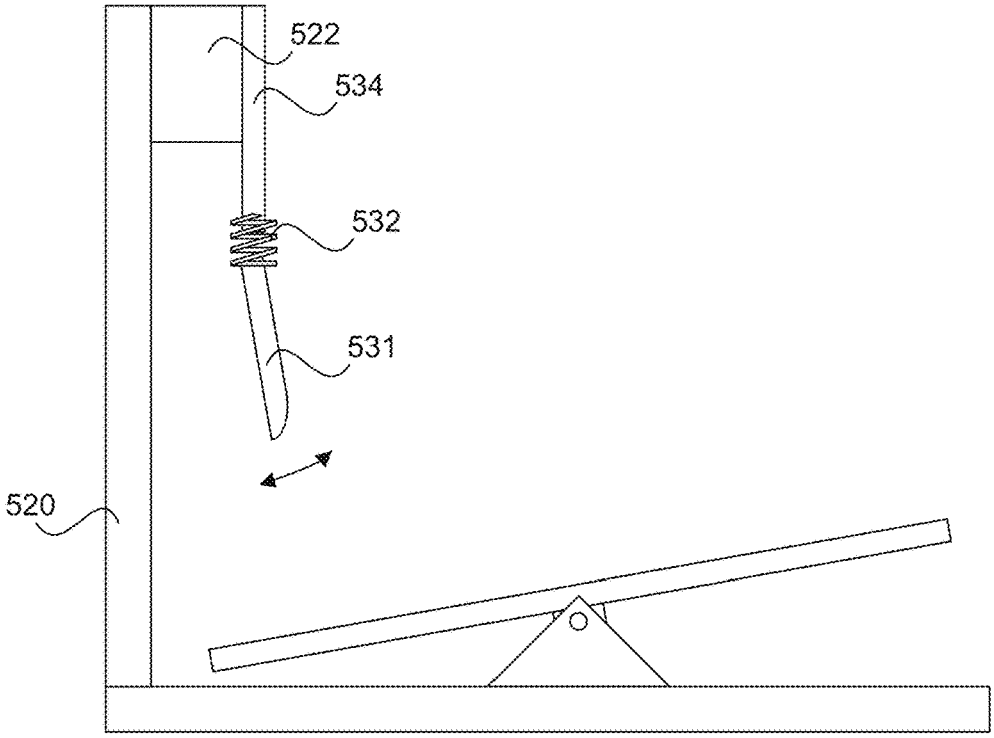
FIGS. 5A-5B illustrate a shoehorn coupled to the vertical support via a resilient member to provide flexibility or adjustability of an angle of the shoehorn, according to embodiments of the present technology.
Figure 5B:
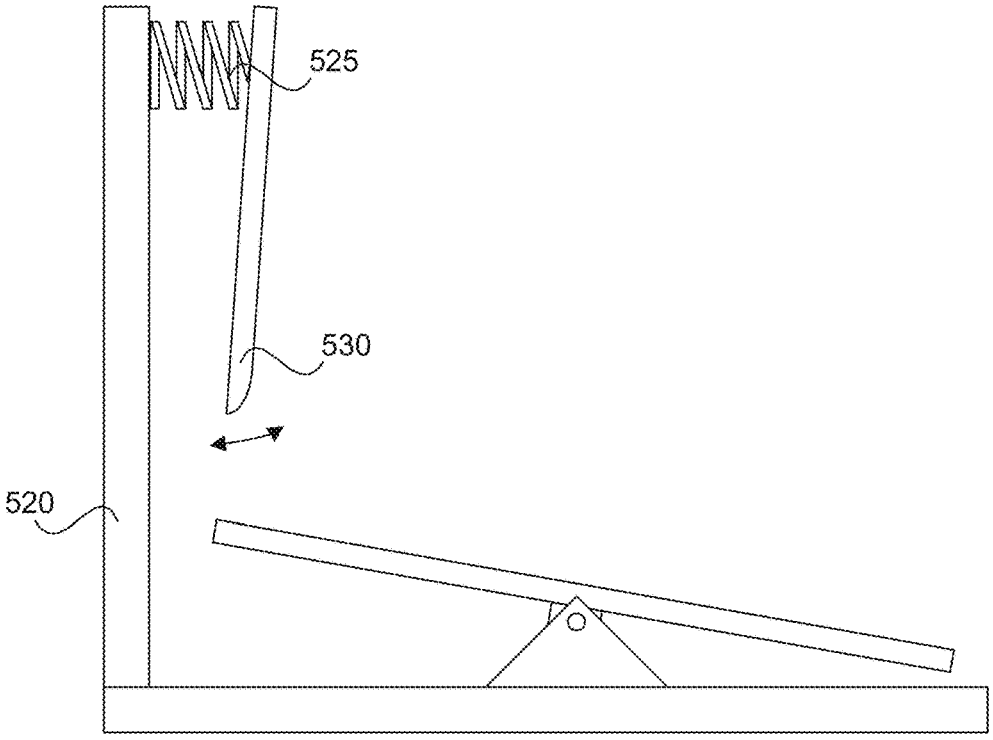

Referring now to FIGS. 5A-5B, embodiments of a hands-free shoehorn device are illustrated in which a shoehorn is coupled to a vertical support 520 via an elastic, spring, or other resilient member. In FIG. 5A, the shoehorn includes an upper portion 534 coupled to a lower portion 531 via a coil spring 532, which allows flexibility of an angle of the shoehorn, which may assist with insertion or removal of the shoehorn from a shoe. The upper portion 534 is coupled to the vertical support 520 via a spacer 522. FIG. 5B illustrates another embodiment where a spring member 525 is provided to couple the shoehorn 530 to the vertical support 520 to allow a similar flexibility of an angle of the shoehorn as the embodiment of FIG. 5A. In one example not illustrated, at least a portion of a shoehorn may be resiliently deformable without inclusion of a spring or the like to obtain a similar effect.

Figure 6:
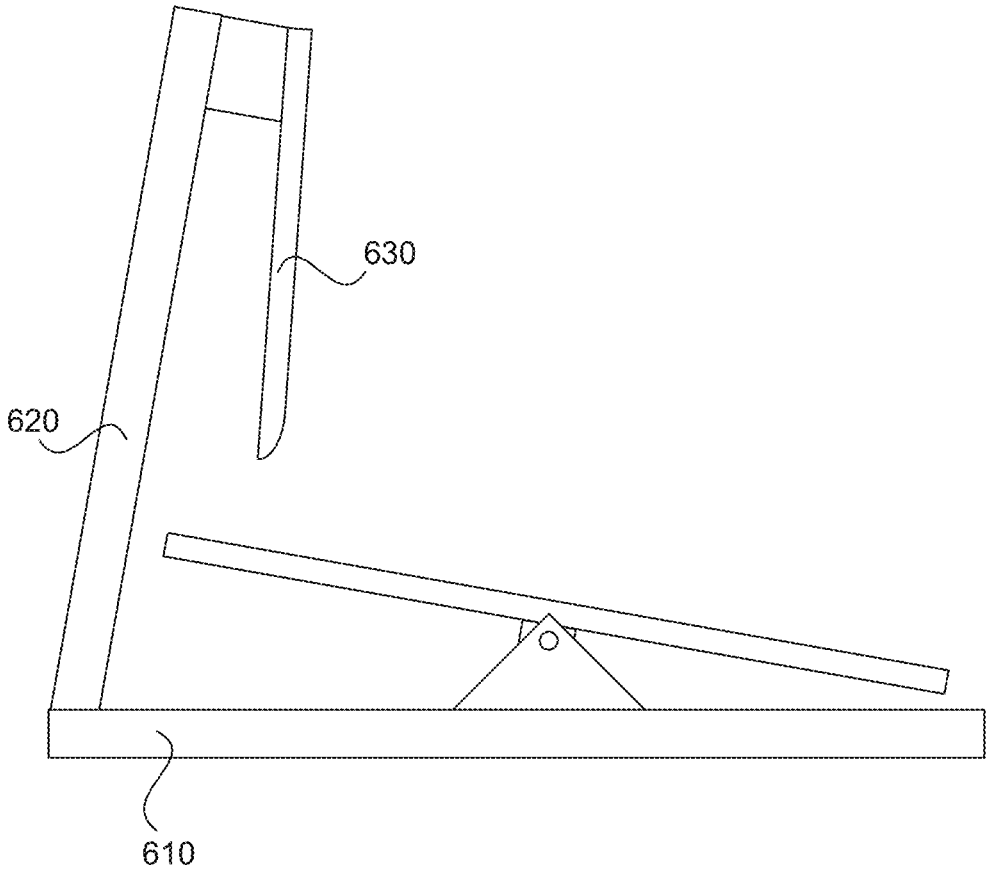
FIG. 6 illustrates a hands-free shoehorn device configured with non-right angles according to an embodiment of the present technology.

Referring briefly to FIG. 6, while many of the embodiments illustrated herein provide various components of the hands-free shoehorn device at right angles to one another, it may be understood that no such limitations are intended. FIG. 6 illustrates an embodiment where an inclination angle of the vertical support 620 relative to the base 610 and of the shoehorn 630 relative to the vertical support 620 is modified from previously described examples. It may be understood that while some of the components may be illustrated as extending straight or in other configurations, other shapes and configurations may also be used. For example, rather than inclining components as in FIG. 6, components may curve or bent. The inclination or curvature or the like may assist in providing a desired position of a shoehorn relative to a shoe support.

Figure 7A:
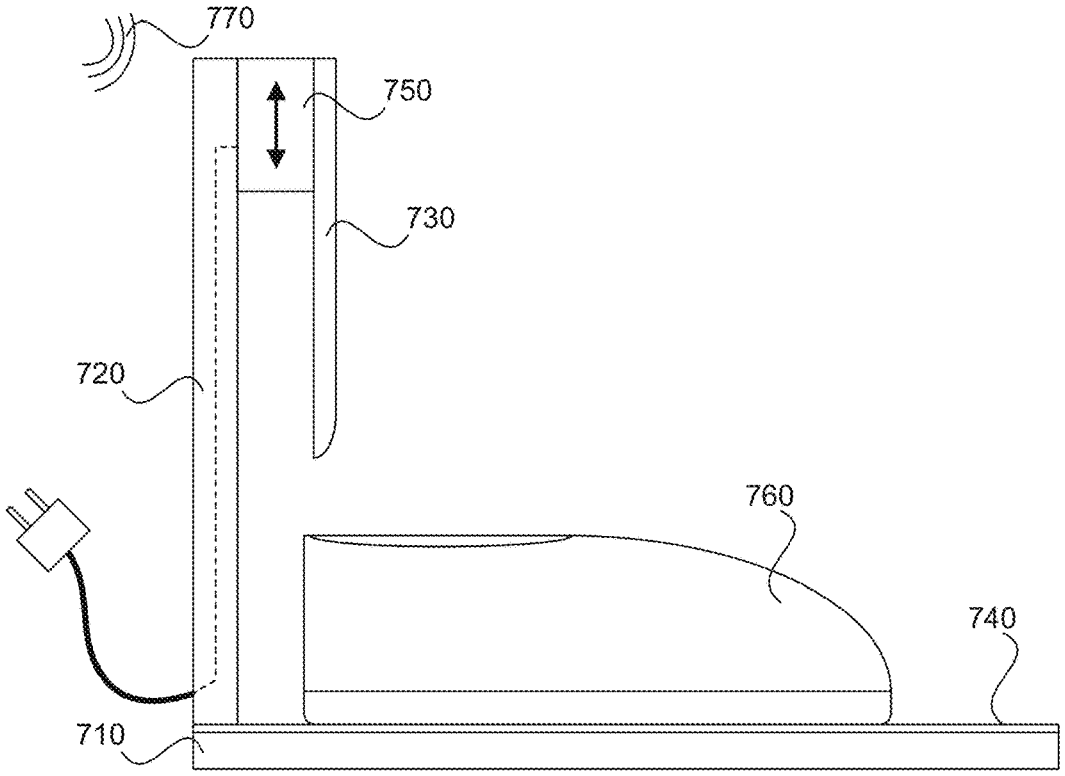
FIGS. 7A-7B illustrate a hands-free shoehorn device configured to adjust a height of the shoehorn using a motor according to an embodiment of the present technology.
Figure 7B:
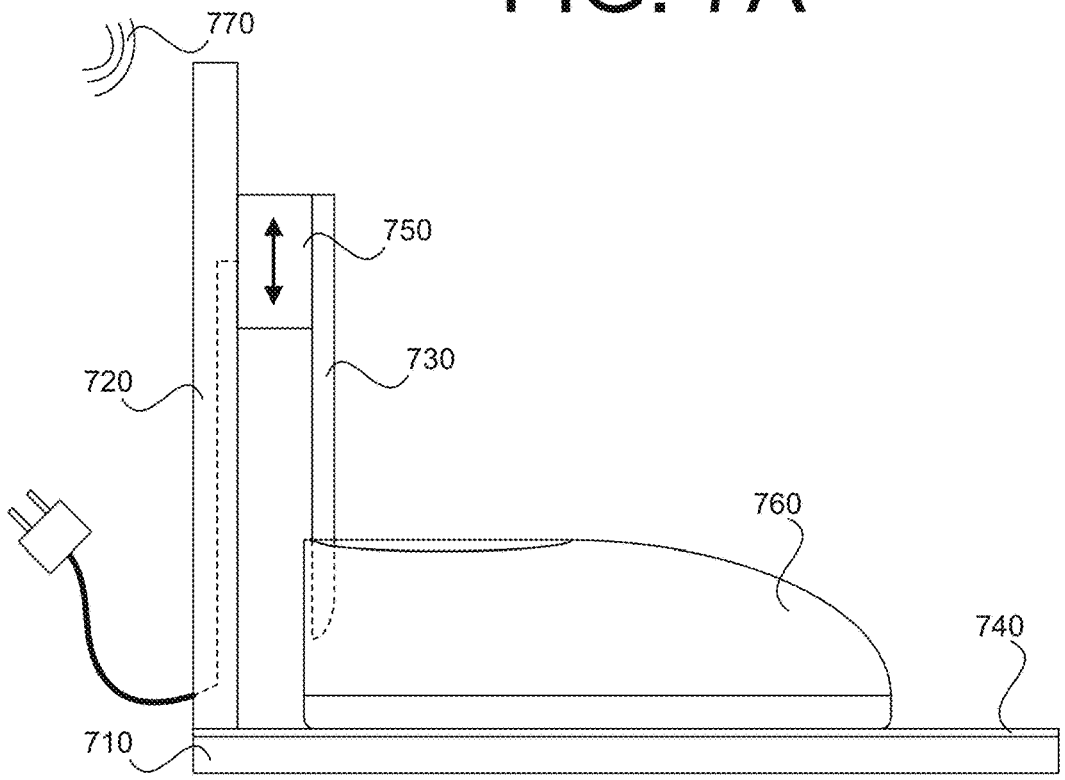

As described above, the shoe support in some embodiments may be configured integrally with the base. FIGS. 7A-7B illustrate an embodiment where the shoe support 740 is configured integrally with the base 710. In this example, the shoe support 740 does not pivot or move. Instead, the shoehorn 730 is moved relative to the shoe support 740 to insert the shoehorn 730 into the shoe 760. A vertical support 720 is coupled to the base 710. In this example, a motor 750 is provided to vertically move the shoehorn 730 relative to the vertical support 720. The motor 750 may include rotate one or more gears to interface with teeth formed on the vertical support 720 to adjust the vertical position of the shoehorn 730. The motor 750 may be an electric motor powered by a battery within a housing of the motor or powered by an external power source, such as in a case where the motor is wired through the vertical support 720 to a cord and plug configured to plug into an electrical outlet. In this example, any of a variety of hands-free mechanisms may be used to activate operation of the motor. For example, the motor 750 may include an audio detector configured to detect voice commands of a user. As another example, the motor 750 may be controllable using a smartphone app. As another example, a wired or wireless button may be provided on, near or remote from the hands-free shoehorn device which, when pressed, causes the motor to move the shoehorn up or down. As another example, a pressure-detecting sensor may be incorporated into the base 710 and by increasing a downward pressure applied by a foot, a signal may cause the motor to move the shoehorn 730 downward, while decreasing or eliminating the downward pressure applied by the foot may generate a signal to cause the motor to move the shoehorn 730 upward. A strength of the motor may be configured such that a user is not likely to be injured if an alignment of the shoe or the foot is not precise during operation. While pressing a button or interacting with an app or the like may in some cases involve a user's hands, because the user is not personally manipulating the shoehorn, these embodiments are considered hands-free. However, various embodiments of the present technology have been described which may be operated without any use of hands whatsoever. FIGS. 7A-7B include a signal 770 which may be a vocal signal in the form of voice commands or a wireless signal such as via wi-fi or radio frequency to activate or operate the motor 750.

Figure 8A:
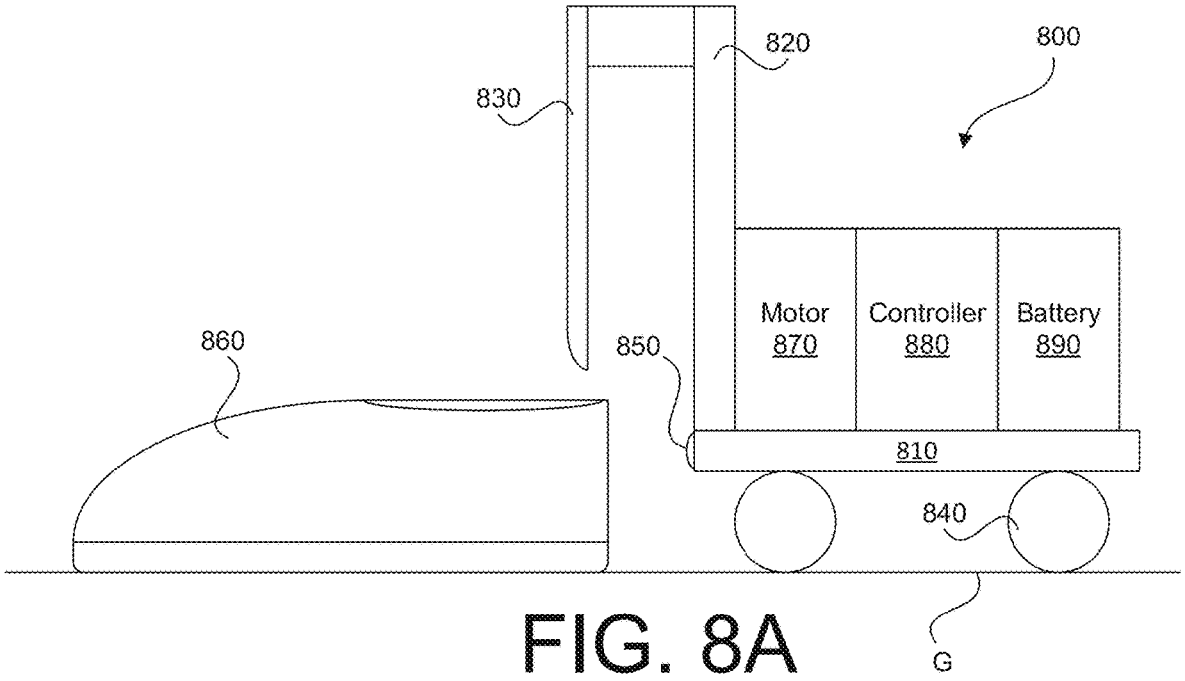
FIGS. 8A-8B illustrate a robotic hands-free shoehorn device according to an embodiment of the present technology.
Figure 8B:
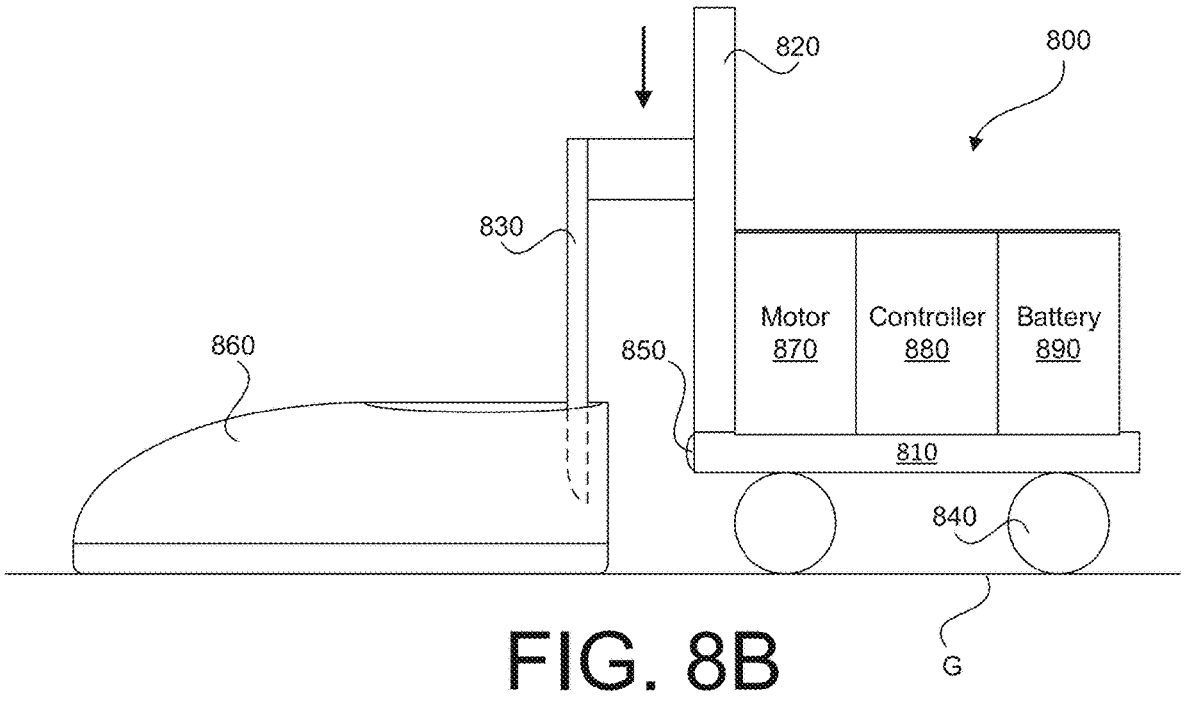

Referring to FIGS. 8A-8B a robotic hands-free shoehorn device 800 is illustrated according to an embodiment of the present technology. In this example, a user's shoe 860 may be placed on the ground G and the robotic device 800 may move to the shoe 860 and vertically adjust the position the shoehorn 830 to insert or remove the shoehorn 830 from the shoe 860. The robotic device 800 in this example includes wheels 840 which support a base 810, a vertical support 820 and the shoehorn 830. The robotic device 800 may include one or more motors 870 configured to operate the wheels 840 as well as the vertical adjustment of the shoehorn 830. The robotic device 800 may include a power source, such as a rechargeable battery 890. One or more sensors 850, which may include one or more cameras, may be provided to detect data, including a position of a shoe. A controller 880 may interpret the data collected by the sensors 850 and operate the one or more motors 870 to position the robotic device 800 and the shoehorn 830 to a desired position relative to the shoe 830. The device of FIGS. 8A-8B may be automated and/or may incorporate various voice control, app control, remote control and/or other mechanisms as have been described or as would otherwise be apparent.

In one example embodiment separate from the robotic example described above, a hands-free shoehorn device can include a plurality of shoe supports and a plurality of shoe horns to more quickly enable a user to wear or remove a pair of shoes. In this embodiment, the shoe supports may be separately pivotable. The shoe supports and shoehorns may be provided adjacently, side-by side on a same base and/or a same vertical support. In one example, a rocker mechanism may couple the shoe supports such that pressing down on a portion of one of the shoe supports forces a portion of another shoe support upward, and vice versa. This may be accomplished, for example, using a semi-circular disc with a flat side at either end coupled to an underside of the shoe supports and a rounded side pivotably coupled to the base.

Some example methods of implementing the present technology have been described above. Some additional example methods are as follows. These methods may be understood as described and/or from the context of the devices and methods which have been heretofore set forth.

A method of operating a hands-free shoehorn device according to one embodiment includes positioning a shoe in proximity to the hands-free shoehorn device, partially inserting a foot into the shoe, and moving at least one of the shoe or a shoehorn toward an other one of the shoe or the shoehorn by a mechanical action without use of human hands such that a portion of the shoehorn is inserted into a heel portion of the shoe. The method may further include inserting the foot further into the shoe, for example such that the heel of the foot is inserted into the shoe. The method may conclude by moving the at least one of the shoe or the shoehorn away from the other one of the shoe or the shoehorn by a reverse mechanical action without use of human hands such that the portion of the shoehorn is removed from the heel portion of the shoe. This method may also be performed in reverse to aid a user in removing a shoe from a foot.

In a further embodiment, the mechanical action and the reverse mechanical action may be performed by a motor. In a different embodiment, at least one of the mechanical action or the reverse mechanical action may be performed by a spring or an elastic. In a different embodiment, at least one of the mechanical action or the reverse mechanical action may be performed by user, using the user's human foot.

In one embodiment of the method, positioning the shoe in proximity to the hands-free shoehorn device comprises positioning the shoe on a shoe support of the hands-free shoehorn device. Further, moving at least one of the shoe or a shoehorn toward an other one of the shoe or the shoehorn in the method may include moving at least one of the shoe support or the shoehorn toward one another.

Another example method of operating a hands-free shoehorn device is provided. In this example, the hands-free shoehorn device includes a base, a vertical support coupled to the base and extending vertically from the base, a shoehorn coupled to the vertical support and extending toward the base, a shoe support coupled to the base and configured to support a shoe, and a pivot upon which the shoe support is pivotable to vertically move an end of the shoe support. The method includes moving the end of the shoe support toward the shoehorn by pivoting the shoe support on the pivot in response to a first force applied to the shoe support. The method also includes moving the end of the shoe support away from the shoehorn by pivoting the shoe support on the pivot in response to a second force applied to the shoe support.

In one embodiment, the pivot is a fulcrum longitudinally positioned along the shoe support between first and second ends of the shoe support including the end of the shoe support. In this embodiment, the method may further include applying the first force to the second end of the shoe support to move the first end of the shoe support toward the shoehorn, the first force being in an opposite direction as the movement of the first end. The method may also include applying the second force to the first end of the shoe support to move the first end of the shoe support away from the shoehorn, the second force being in a same direction as the movement of the first end. This embodiment is illustrated, for example, in FIGS. 2A-2F.

In one embodiment, the shoe support is coupled to the base via a spring. The method in this embodiment may further include applying the first force by a human foot to the shoe support to move the end of the shoe support toward the shoehorn, and applying the second force to the end of the shoe support by the spring to move the end of the shoe support away from the shoehorn. This embodiment is illustrated, for example, in FIG. 3A.

The hands-free shoehorn device as described herein is useful in assisting humans in putting shoes on or removing shoes from feet. Examples implementation of the present technology provide a hands-free device which is stable, sturdy, and compact for easy storage when not in use. The device is configured for safe use by people of all abilities and can be adapted for a variety of circumstances, shoe types and the like. In testing, users have been able to readily and easily learn how to use the device either without any explanation or with only a brief explanation and/or demonstration.

The described features, structures, or characteristics may be combined in any suitable manner in one or more examples. In the preceding description numerous specific details were provided, such as examples of various configurations to provide a thorough understanding of examples of the described technology. One skilled in the relevant art will recognize, however, that the technology may be practiced without one or more of the specific details, or with other methods, components, devices, etc. In other instances, well-known structures or operations are not shown or described in detail to avoid obscuring aspects of the technology.

Reference has been made to the examples illustrated in the drawings, and specific language has been used herein to describe the same. It will nevertheless be understood that no limitation of the scope of the technology is thereby intended. Alterations and further modifications of the elements illustrated herein, and additional applications of the examples as illustrated herein, which would occur to one skilled in the relevant art and having possession of this disclosure are to be considered within the scope of the description.

With the general examples set forth herein, it is noted that when describing a system, or the related devices or methods, individual or separate descriptions are considered applicable to one other whether or not explicitly discussed in the context of a particular example or embodiment. Furthermore, various modifications and combinations may be derived from the present disclosure and illustrations, and as such, the figures should not be considered limiting.

Although the subject matter has been described in language specific to structural features and/or operations, it is to be understood that the subject matter defined in the appended claims is not necessarily limited to the specific features and operations described above. Rather, the specific features and acts described above are disclosed as example forms of implementing the claims. Numerous modifications and alternative arrangements may be devised without departing from the spirit and scope of the described technology.

What is claimed is:

1. A hands-free shoehorn device, comprising:

a base;

a vertical support coupled to the base and extending vertically from the base;

a shoehorn coupled to the vertical support and extending toward the base;

a shoe support coupled to the base and having a length configured to support a heel portion and a toe portion of a shoe; and a pivot upon which the shoe support is pivotable to vertically move one end of shoe support, the pivot having a fixed position relative to the base; wherein the shoe support is pivotable upon the pivot without altering an orientation of the shoehorn relative to the base;

at least a portion of the shoe support is vertically movable toward the shoehorn by pivoting the shoe support upon the pivot;

an entirety of the length of the shoe support rotates about the fixed position by pivoting the shoe support upon the pivot; and the shoehorn has a fixed and substantially parallel orientation relative to the vertical support.

2. The hands-free shoehorn device according to claim 1, wherein the vertical support has an adjustable height configured to adjust a height of the shoehorn relative to the shoe support; and the shoehorn is vertically movable toward the shoe support by adjustment of the adjustable height of the vertical support.

3. The hands-free shoehorn device according to claim 1, wherein the shoe support is coupled to the base via an elastic or a spring.

4. The hands-free shoehorn device according to claim 3, comprising the spring, wherein the spring comprises at least one selected from the group consisting of: a cantilever spring, a coil spring, and a torsion spring.

5. The hands-free shoehorn device according to claim 1, wherein the shoe support is configured to rotate about the fixed position of the pivot to move between opposite directions of inclination relative to the base.

6. The hands-free shoehorn device according to claim 1, wherein the shoe support is pivotable in opposite directions about the pivot in response to forces applied at opposite longitudinal ends of the shoe support.

7. The hands-free shoehorn device according to claim 1, wherein the shoe support is configured to pivot bidirectionally in response to user-applied forces at each of opposite ends of the shoe support.

8. A hands-free shoehorn device, comprising:

a base;

a vertical support coupled to the base and extending vertically from the base;

a shoehorn coupled to the vertical support and extending toward the base;

a shoe support coupled to the base and having a length configured to support a heel portion and a toe portion of a shoe; and a pivot upon which the shoe support is pivotable to vertically move one end of shoe support, the pivot having a fixed position relative to the base; wherein the shoe support is pivotable upon the pivot without altering an orientation of the shoehorn relative to the base;

at least a portion of the shoe support is vertically movable toward the shoehorn by pivoting the shoe support upon the pivot;

an entirety of the length of the shoe support rotates about the fixed position by pivoting the shoe support upon the pivot; and a portion of the shoehorn configured to be inserted into the shoe has a fixed orientation relative to the vertical support.

9. The hands-free shoehorn device according to claim 8, wherein the shoehorn has a fixed orientation relative to the vertical support.

10. A hands-free shoehorn device, comprising:

a base;

a vertical support coupled to the base and extending vertically from the base;

a shoehorn coupled to the vertical support and extending toward the base;

a shoe support coupled to the base and having a length configured to support a heel portion of a shoe at a heel end of the shoe support and a toe portion of the shoe at a shoe end of the shoe support; and a pivot upon which the shoe support is pivotable to vertically move one end of shoe support, the pivot having a fixed position relative to the base, the fixed position being distal from the heel end of the shoe support by at least half of the length of the shoe support; wherein the shoe support is pivotable upon the pivot without altering an orientation of the shoehorn relative to the base;

at least a portion of the shoe support is vertically movable toward the shoehorn by pivoting the shoe support upon the pivot; and an entirety of the length of the shoe support rotates about the fixed position by pivoting the shoe support upon the pivot.

11. The hands-free shoehorn device according to claim 10, wherein the shoehorn is coupled to the vertical support via an elastic or a spring.

12. The hands-free shoehorn device according to claim 10, wherein the shoehorn comprises a spring.

13. The hands-free shoehorn device according to claim 10, wherein the shoehorn is resiliently deformable.

14. The hands-free shoehorn device according to claim 10, wherein the pivot is positioned at a center of the length of the shoe support.

* * * * *